United States Patent [19]

Stephens et al.

[11] Patent Number: 4,583,716

[45] Date of Patent: Apr. 22, 1986

[54] UNIVERSAL ANCHOR ASSEMBLY FOR IMPACT ATTENUATION DEVICE

[75] Inventors: Barry D. Stephens, Citrus Heights; Peter B. Morehead, Sacramento; James B. Welch, Placerville, all of Calif.

[73] Assignee: Energy Absorption Systems, Inc., Chicago, Ill.

[21] Appl. No.: 379,868

[22] Filed: May 19, 1982

[51] Int. Cl.[4] ..... A01K 3/00; E01F 15/00

[52] U.S. Cl. ..... 256/13.1; 248/499; 188/377

[58] Field of Search ..... 256/13.1, 1; 248/499, 248/500, 68.1; 188/377, 371, 266; 267/139, 140.1

[56] References Cited

U.S. PATENT DOCUMENTS

| | | | |
|---|---|---|---|
| Re. 29,544 | 2/1978 | Fitch | 256/13.1 |
| 3,284,122 | 11/1966 | Rich | 293/1 |
| 3,503,600 | 3/1970 | Rich | 267/1 |
| 3,666,055 | 5/1972 | Walker et al. | 188/1 C |
| 3,672,657 | 6/1972 | Young et al. | 267/166 |
| 3,674,115 | 7/1972 | Young et al. | 188/1 B |
| 3,680,662 | 8/1972 | Walker et al. | 188/1 B |
| 3,944,187 | 3/1976 | Walker | 256/13.1 |
| 3,982,734 | 10/1976 | Walker | 256/13.1 |
| 4,072,334 | 2/1978 | Seegmiller et al. | 293/71 R |
| 4,352,484 | 10/1982 | Gertz et al. | 256/1 X |
| 4,452,431 | 6/1984 | Stephens et al. | 256/13.1 |

*Primary Examiner*—Andrew V. Kundrat

*Attorney, Agent, or Firm*—Willian Brinks Olds Hofer Gilson & Lione Ltd.

[57] ABSTRACT

A universal front anchoring system for reusable impact attenuation devices is provided. Buffer elements are positioned in an ordered array extending forwardly of a rigid backing member adjacent to a fixed structure. Diaphragm members are interposed in the array and extend laterally outward of the array at fixed intervals. Fender panels are pivotally coupled to laterally extending ends of the diaphragm members and extend rearwardly from their associated diaphragm members and partially overlap the fender panels coupled to the succeeding diaphragm members. Nonrigid means such as restraining cables and secondary cables interconnects the backing member and the diaphragm members. A pair of laterally spaced anchor assemblies is connected to the nonrigid means at the forward end of the impact attenuation device. The anchor assemblies are adapted for fixing to the ground and are symmetrical, identical and interchangeable with each other. Preferably, the anchor assemblies have a large central mounting bracket for securing one of the restraining cables and two smaller mounting brackets laterally spaced on opposite sides of the central mounting bracket, one of which is used to secure one of the secondary cables.

7 Claims, 6 Drawing Figures

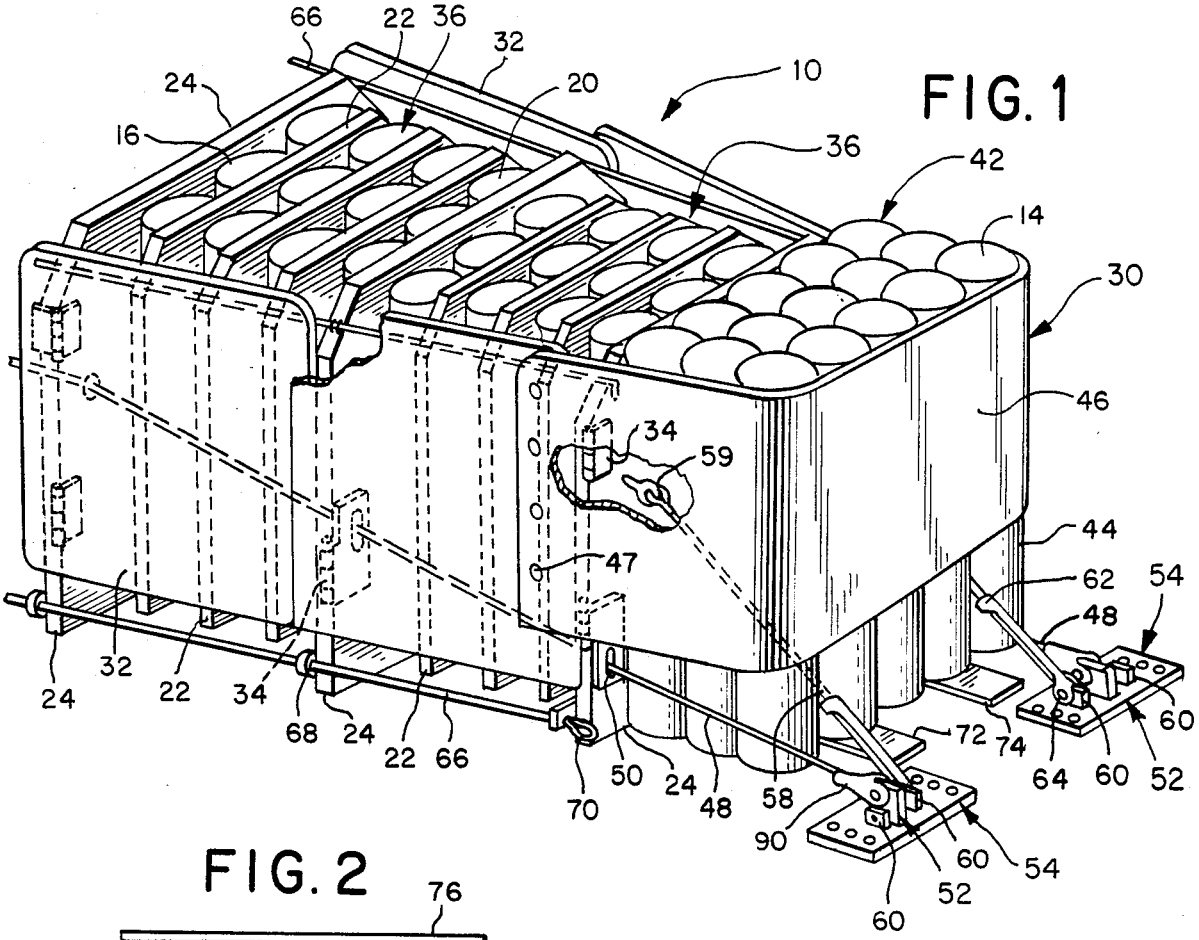
FIG. 1
FIG. 2
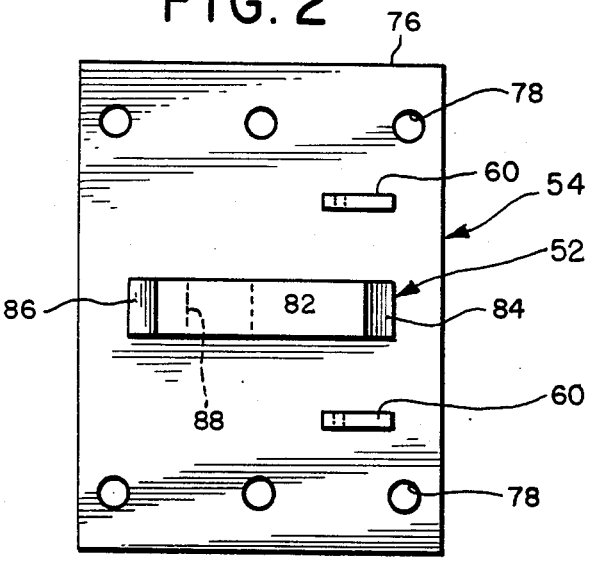
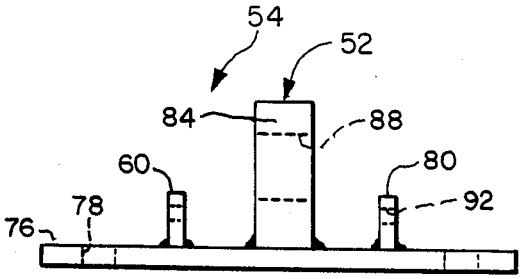
FIG. 4
FIG. 3
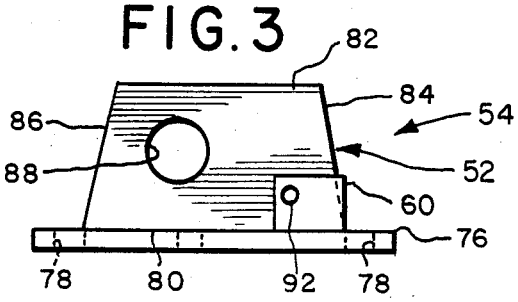

UNIVERSAL ANCHOR ASSEMBLY FOR IMPACT ATTENUATION DEVICE

BACKGROUND OF THE INVENTION

The present invention is directed to an improvement in a device for safely protecting fixed structures from damage resulting from colliding vehicles or the like. More particularly, this invention is directed to a universal anchor assembly for a reusable impact attenuation device for absorbing and harmlessly dissipating the impact energy of a colliding vehicle.

It is known that rigid guardrails and similar immovable protective devices alongside vehicular traffic routes such as highspeed highways may be used for the purpose of preventing vehicles from colliding with fixed structures such as, for example, abutments, columns, and sign supports. A common practice is to place a rigid railing between the vehicular traffic route and the fixed structure to deflect the vehicle in such a manner that the vehicle avoids direct impact with the fixed structure. Such devices are of only limited value since they do not decelerate the vehicle at a controlled, safe rate to provide maximum safety and minimum injury to the occupants of the impacting vehicle. Further, such devices result in the impacting vehicle being thrown back onto the highway into the path of other moving vehicles.

It is also known that an improved and reusable impact attenuation device for protecting stationary structures from damage due to impacting vehicles can be provided utilizing an array of energy absorbing buffer elements arranged in chambers which sandwich or telescope into each other upon impact. Such chambers can be formed partially by fender panels which extend rearwardly in their normal positions to aid in properly redirecting a vehicle after a lateral impact to the protective device. U.S. Pat. Nos. 3,674,115 and 3,944,187 disclose such reusable impact attenuation devices having liquid and dry buffer elements, respectively.

Although the reusable impact attenuation devices of U.S. Pat. Nos. 3,674,115 and 3,944,187 have greatly advanced the art and have gained wide acceptance and recognition, a need exists for an improvement in the anchoring system of those impact attenuation devices. More specifically, present reusable impact attenuation devices require a different width of anchor assembly for each of several size increments in which the impact attenuation devices are assembled. Further, the anchor assemblies required for those impact attenuation devices having liquid buffer elements are different from the anchor assemblies required for those impact attenuation devices having dry buffer elements. As a result, manufacturing costs, inventory costs, and installation costs are higher than if a more uniform anchoring system were used.

Accordingly, it is an object of this invention to provide an improved impact attenuation device having a universal anchor assembly which can be used regardless of the size of the impact attenuation device and regardless of the type of buffer elements used.

SUMMARY OF THE INVENTION

The present invention is directed to an improvement in a reusable impact attenuation device for safely protecting fixed structures from damage resulting from colliding vehicles or the like.

According to this invention, an improved anchoring system is provided for a reusable impact attenuation device. In the present invention, buffer elements are positioned in an ordered array extending forwardly of a rigid backing member adjacent to a fixed structure. Diaphragm members are interposed in the array and extend laterally outward of the array at fixed intervals. Fender panels are pivotally coupled to opposed ends of the diaphragm members and extend rearwardly from their associated diaphragm members and partially overlap the fender panels coupled to the succeeding diaphragm members. Nonrigid means interconnects the backing member and the diaphragm members. A pair of laterally spaced anchor assemblies is connected to the nonrigid means at the forward end of the impact attenuation device. The anchor assemblies are adapted for fixing to the ground and are symmetrical, identical, and interchangeable with each other.

Preferably, the anchor assemblies include a base plate, central mounting means, and secondary mounting means. The secondary mounting means includes two mounting locations equally spaced laterally from opposite sides of the central mounting means, the two mounting locations being symmetrical with respect to the central mounting means. The anchor assemblies may include a base plate to which the central mounting means and secondary mounting means are secured. The central mounting means may be a bar having an opening, preferably adjacent the rearward end of the bar, to receive a shackle of the nonrigid means. Preferably, the secondary mounting means comprises brackets adjacent the forward end of the anchor assemblies. The anchor assemblies may be economically welded of steel bar and plate and may include mounting holes for fastening to the ground.

The invention, together with further objects and attendant advantages, will be best understood with reference to the following detailed description taken in conjunction with the accompanying drawings.

BRIEF DESCRIPTION OF THE DRAWINGS

FIG. 1 is a perspective view of a portion of a first impact attenuation device having anchor assemblies made in accordance with the present invention;

FIG. 2 is an enlarged plan view of an anchor assembly of the impact attenuation device of FIG. 1;

FIG. 3 is an enlarged side view of an anchor assembly of the impact attenuation device of FIG. 1;

FIG. 4 is an enlarged front view of an anchor assembly of the impact attenuation device of FIG. 1;

DETAILED DESCRIPTION OF A PREFERRED EMBODIMENT

Figure 5:
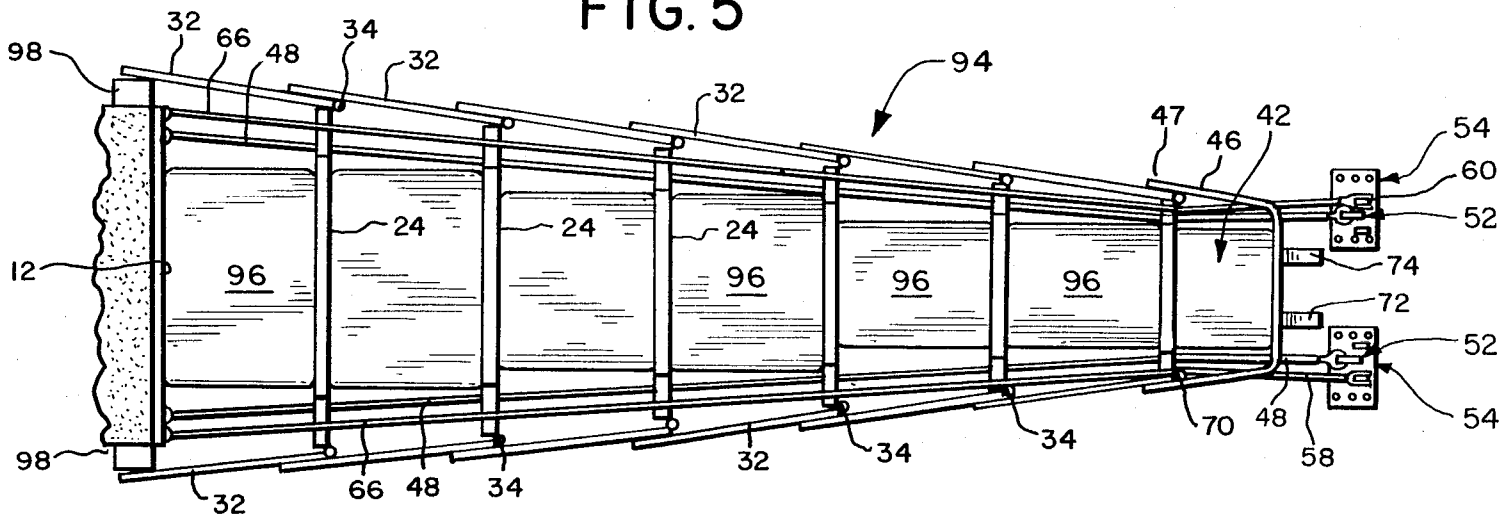
FIG. 5 is a plan view of a second impact attenuation device having anchor assemblies made in accordance with the present invention before an impact.

With reference to the drawings, a first impact attenuation device having anchor assemblies made in accordance with the invention is indicated generally by the numeral 10 in FIG. 1. The impact attenuation device 10 includes a rigid backing member (not shown) similar to that shown in FIG. 5, and indicated by the reference symbol 12 which is normally fixed adjacent a stationary structure to be protected near a route of vehicular traffic, such as a street or highway. The backing member 12 is provided to reinforce the stationary structure. Positioned in front of and abutting the backing member 12 is an array of buffer elements 14 which are partially filled with an incompressible fluid, preferably water.

The buffer elements 14 are collapsible cell cartridges which have the characteristic of remaining flexible and watertight in extremes of heat and cold. As an example, and not by way of limitation, the buffer elements 14 may comprise vinyl coated nylon fabric cylinders with an open upward end and a diameter of approximately 5½ inches. The length may vary as required by the installation, but lengths of 24, 30 and 36 inches have been found to be satisfactory for most installations. The base fabric of the buffer elements 14 may, for example, consist of 6.1 ounce nylon and may be coated with vinyl to produce a weight of 22 ounces per yard. This material offers a hydrostatic resistance of 300 or more pounds per square inch.

Cell inserts 16 containing sharp-edged orifices are fixed to the open ends of the buffer elements 14. Upon impact, water is controllably released from the buffer elements 14 by turbulent viscous flow through the orifices in the manner taught in U.S. Pat. No. 3,503,600 entitled "Liquid Shock Absorber", issued to John W. Rich. The size of the orifices is predetermined based upon speed limits, weights of vehicles, desired deceleration rates, and other factors. The buffer elements 14 are arranged in rows, indicated generally by the numeral 20, substantially parallel to the backing member 12. The rows 20 of the buffer elements 14 are mounted upon interior panels 22 and diaphragm members 24.

Toward the forward end of the device 10, indicated generally by the numeral 30, the lateral dimensions of the interior panels 22 and of the rows 20 are reduced, and the number of the buffer elements 14 in the rows 20 may be reduced correspondingly. At regularly spaced intervals, the diaphragm members 24 extend laterally beyond the associated rows 20 to provide a pivotal mounting of fender panels 32 which are attached by hinges 34 having removable pins to facilitate replacement of damaged fender panels. The fender panels 32 extend rearwardly from the associated diaphragm members 24 so as to enclose the interior panels 22 and the buffer elements 14 to form buffer chambers, indicated generally by the numeral 36.

Each of the buffer chambers 36 is of a lesser width than the succeeding buffer chambers 36 in a direction extending away from the backing member 12 to enhance the ability of the buffer chambers 36 to telescope one into the other upon impact. The fender panels 32 extend rearward from the associated diaphragm members 24 sufficiently to overlap portions of the fender panels 32 associated with the adjacent and rearward one of the diaphragm members 24. The most rearward of the fender panels 32 overlap the backing member 12 and (in a manner not shown) may be separated therefrom by one of the buffer elements 14 to provide cushioning during a side impact to the impact attenuation device 10.

The diaphragm members 24 may be fabricated, for example, from 1½ inch thick laminated wood coated on both sides with fiber reinforced plastic. The fender panels 32 may be constructed of any suitable material such as, for example, ¾ to 1¼ inch thick plywood and are, preferably, coated on both faces with fiber reinforced plastic having a low coefficient of friction. The interior panels 22 may be constructed of ½ inch thick plywood, preferably coated on both faces with an enamel paint. It is to be understood that the thickness of the interior panels 22, the diaphragm members 24, and the fender panels 32 may be varied from these dimensions depending upon the force of impact against which the impact attenuation device 10 is designed to protect.

At the forward end 30, immediately adjacent the first of the diaphragm members 24, is a forward cluster 42 of the buffer elements 14 substantially as disclosed in the previously described U.S. Pat. No. 3,503,600. Instead of being mounted upon the interior panels 22 and the diaphragm members 24, the buffer elements 14 in the forward cluster 42 are, preferably, supported by hollow, vinyl plastic cylinders 44 which are stacked together as shown in FIG. 1. The buffer elements 14 of the forward cluster 42 are enclosed by a flexible nose covering 46 which is secured to the first of the fender panels 32 by suitable fasteners such as wood screws 47. The flexible nose covering 46 may be a plastic such as vinyl and may include slots to accommodate cables.

Two restraining cables 48 are securely fastened to the rigid backing member 12 and are led forward through reinforced apertures 50 in the diaphragm members 24 to central mounting brackets, indicated generally by the numeral 52, of fixed anchor assemblies, indicated generally by the numeral 54. The reinforced apertures 50 are progressively lower in the two forwardmost of the diaphragm members 24 to permit the paths for the restraining cables 48 to be in a plane, as shown in FIG. 1. The restraining cables 48 also pass along the lateral edges of the interior panels 22, which include metal reinforced side portions (not shown) for contacting the restraining cables 48 to protect the interior panels 22 from excessive wear. From the third diaphragm member rearward, the restraining cables 48 extend horizontally to the rigid backing member (not shown).

A pair of secondary cables 58 is provided between the forwardmost of the diaphragm members 24 and smaller secondary mounting brackets 60 of the anchor assemblies 54. The secondary cables 58 are secured to the forwardmost diaphragm member by eyebolts 59, as shown in FIG. 1, to maintain the impact attenuation device 10 in a normal position until an impact. The secondary cables 58 are provided with turnbuckles 62 which facilitate tightening of the secondary cables 58 and with shear pins 64 which shear upon impact. Metal slide straps 72 and 74 are provided below the diaphragm members 24 along the length of the impact attenuation device 10 to ensure that the diaphragm members are readily movable upon impact and to reduce abrasion.

Pullout cables 66 are attached to the corners of each of the diaphragm members 24 by means of cable clamps 68 provided at the four corners of each of the diaphragm members 24. A loop 70 is provided in the forward end of each of the pullout cables 66 for use in returning the impact attenuation device 10 to its original shape after an impact by applying a tension force to the loops 70. The pullout cables 66 also cooperate with the buffer elements 14 during a lateral impact to transfer the energy of impact for improved energy absorption and dissipation, as discussed below. The turnbuckles 62 maintain the pullout cables 66 in a taut condition until an impact to the impact attenuation device 10.

It is a particular feature of the present invention that the anchor assemblies 54 are identical and are laterally spaced adjacent the forward end 30 of the impact attenuation device 10. It will be appreciated that the anchor assemblies 54 may be spaced more widely apart with larger sizes of the impact attenuation device 10 and may be placed more closely together with smaller sizes of the impact attenuation device 10. As a result, a single size of the anchor assemblies 54 may be used universally on all sizes of the impact attenuation device 10, two of the anchor assemblies 54 being required on each impact attenuation device 10.

It is a further feature of the present invention that the anchor assemblies 54 are symmetrical about the central mounting brackets 52, as shown in FIGS. 2 and 4. The secondary mounting brackets 60 are equally spaced from and laterally opposite the central mounting bracket 52. It will be noted that only one of the secondary mounting brackets 60 is required for the mounting of each of the secondary cables 58 and that the required secondary mounting bracket must be laterally inward of the adjacent one of the restraining cables 48. The laterally outward one of the secondary mounting brackets 60 of the anchor assemblies 54 remains unused. As a result of this feature, identical anchor assemblies 54 may be used at the left and right sides of the forward end 30 of the impact attenuation device 10.

The anchor assemblies 54 include a rectangular base plate 76 having regularly spaced mounting holes 78 for fixing the anchor assemblies 54 to the ground. Various forms of fasteners such as concrete anchor bolts or hexagonal head bolts may be used to secure the anchor assemblies 54 to wood, concrete, or steel comprising the ground over which the impact attenuation device 10 is mounted. The number, size, and placement of the mounting holes 78 shown in FIGS. 2–4 are merely illustrative as many of the configurations of mounting holes 78 could be used. In the preferred embodiment shown, the base plate 76 is ½ inch thick, 10 inches long, and 13 inches wide, and the mounting holes 78 are ⅞ inch in diameter, 3 along each lateral side of the base plate 76. The central mounting bracket 52 and the smaller secondary mounting brackets 60 comprise substantially rectangular parallel bars mounted upon the base plate 76.

Applicants prefer that the central mounting bracket 52 be formed in a trapezoid configuration although other configurations could be employed with similar effect. A base portion 80, a parallel top portion 82, a sloping front end 84, and a sloping rear end 86, may be formed from 1½ inch by 4 inch bar stock, as shown in FIG. 3. The base portion 80 of the preferred embodiment has a length of 7¼ inches, for example, and may be conveniently fixed to the base plate 76 by welding, as shown in FIG. 4. A mounting hole 88 is positioned toward the rear end 86 of the central mounting bracket 52 and is large enough to accomodate a large shackle 90 fitted to the end of each of the restraining cables 48, as shown in FIG. 1. The rearward position of the mounting hole 88 provides a more uniform loading of the fastening means at the mounting holes 78 and on the welded joint between the central mounting bracket 52 and the base plate 76.

The secondary mounting brackets 60 are configured and mounted similarly to the central mounting bracket 52 but are positioned near the forward end of the base plate 76. The forward location allows the anchor assemblies 54 to be placed nearer the impact attenuation device 10 while maintaining the preferred angle of the secondary cables 58. The secondary mounting brackets 60 are not as large or as strong as the central mounting bracket 52 because the secondary cables 58 only serve to keep the forwardmost of the diaphragm members 24 in position before an impact. A small mounting hole 92 is provided near the rear of each of the secondary mounting brackets 60 to receive the shear pin 64. In the preferred embodiment shown, the secondary mounting brackets 60 are 2 inch lengths of ⅜ inch by 1½ inch bar stock, and the mounting hole 92 has a diameter of 5/16 inch to closely receive the shear pin 64 and provide shearing surfaces which cooperate with the shackle of the turnbuckle 62. The preferred material for the base plate 76, the central mounting bracket 52, and the secondary mounting brackets 60 is mild steel such as ASTM A36 or AISI M1020; however, other materials could be used with similar effect.

The anchor assemblies 54 of the present invention are not limited to use with the first impact attenuation device 10, having liquid buffer elements 14, as shown in FIG. 1. In addition, the anchor assemblies 54 may be used with a second impact attenuation device 94, having dry buffer elements 96 and 98, as shown in FIG. 5. The buffer elements 96 and 98 include expanded mica cells which are wrapped with wire and asphalt coated foil as described in U.S. Pat. No. 3,666,055. The mica cells crush on impact allowing the buffer elements 96 and 98 to compress as they absorb and dissipate energy. The wire wrapping serves to regulate the collapsing of the buffer elements 96 and 98 in a manner analogous to the operation of the orifices of the first impact attenuation device 10.

It will be noted that the secondary cables 66 of the second impact attenuation device 94 are mounted laterally outward of the restraining cables 48 rather than inward as on the first impact attenuation device 10. In the past, this laterally outward mounting of the secondary cables 60 has required specially manufactured anchor assemblies which could not be used on the first impact attenuation device 10. It is a particular feature of the anchor assemblies 54 that the laterally outward secondary mounting brackets 60 may be used with the second impact attenuation device 94, leaving the inward secondary mounting brackets 60 unused. As a result, the same anchor assemblies 54 can be used universally on either the first impact attenuation device 10 or the second impact attenuation device 94.

OPERATION OF THE PREFERRED EMBODIMENT

Figure 6:
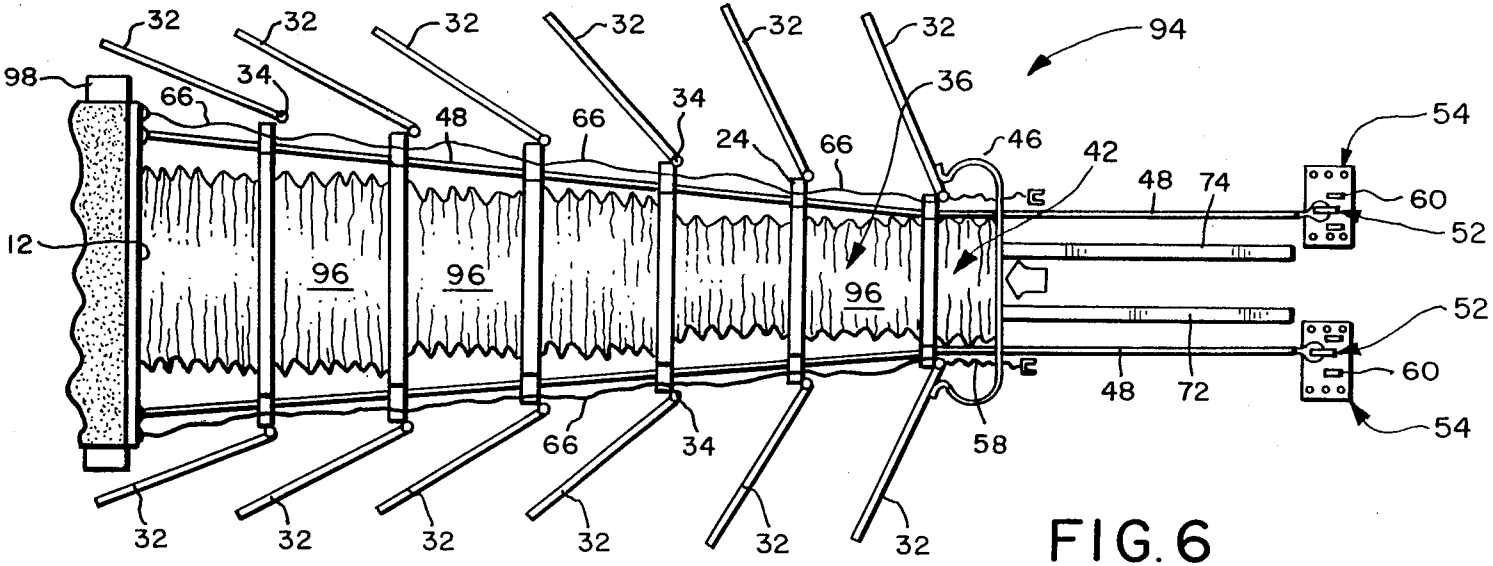
FIG. 6 is a plan view of the impact attenuation device of FIG. 5 during an impact directed against the front of the impact attenuation device.

A vehicle impacting the first impact attenuation device 10 may first contact and compress the forward cluster 42 located ahead of the forwardmost of the diaphragm members 24. Due to the low position of the anchor assemblies 54, the vehicle passes over the anchor assemblies 54 without impact. A portion of the impact energy of the moving vehicle is then absorbed and dissipated by the regulated flow of fluid from the buffer elements 14 of the forward cluster 42 through the orifices of the cell inserts 16. FIGS. 5 and 6 show the second impact attenuation device 94 before and during such an impact. Although the description which follows is directed to the operation of the first impact attenuation device 10, it should be understood that the second impact attenuation device 94 has a similar operation.

As the vehicle continues, the forward cluster 42 is forced rearward, and the remaining impact energy is transferred to the forwardmost of the diaphragm members 24, which slides rearward on the slide straps 72 and 74 and compresses the buffer elements 14 within the chamber behind the forwardmost diaphragm member. A further portion of the energy of impact is absorbed and dissipated by the buffer elements 14 as fluid in those elements is discharged through the orifices at a rate commensurate with the impact force. The diaphragm members 24 and the interior panels 22 serve to uniformly distribute the force of impact between the buffer elements 14 within each of the rows 20. As the buffer elements 14 of that chamber are compressed, a force is applied to the succeeding one of the diaphragm members 24, which moves along the slide straps 72 and 74 and applies a compressive force to the succeeding chamber of the buffer elements 14.

The energy absorption and dissipating process described above is repeated successively, with the remaining force of impact being transmitted to the succeeding adjacent one of the diaphragm members 24. The heavier the vehicle and the greater its speed, the greater the number of successive diaphragm movements which will be required to dissipate the kinetic energy and bring the vehicle to a stop. Since each of the diaphragm members 24 is successively wider than the preceding one, a stepped or telescoped effect is provided. The larger mass of the row of the buffer elements 14 and of the interior panels 22 associated with the larger diaphragm members 24 nearer the backing member 12 gives the rear portion of the buffer device 10 a higher degree of energy absorbing capability. Therefore, as the vehicle moves toward the backing member 12, the resistive forces acting to bring the vehicle to a halt increase.

The tender panels 32 swing outwardly on the hinges 34 in response to the movement of the diaphragm members 24 toward each other and the inertia of the fender panels 32 themselves. The outward movement of the fender panels 32 requires an additional expenditure of energy and thereby assists the device in further slowing the vehicle. As the diaphragm members 24 move toward each other while compressing the buffer elements 14 during impact, the restraining cables 48 control the movement of the diaphragm members 24 and prevent the impact attenuation device 10 from buckling in the lateral and vertical directions. Due to the shear pins 64, the secondary cables 58 are released from the secondary mounting brackets 60 of the anchor assemblies 54 upon impact.

The impact attenuation device 10 is also effective in redirecting a side angle impact. The force of the impacting vehicle causes the fender panels 32 on the impacted side of the impact attenuation device 10 to remain in an inward position and act as fenders to deflect the vehicle away from the impact attenuation device 10. Instead of directing the vehicle into the lane of oncoming traffic, the vehicle is effectively fendered away in a direction substantially parallel to the impact attenuation device 10.

The restraining cables 48 resist lateral movement yet yield sufficiently to reduce the force of impact reacting against the vehicle. The low coefficient of friction of the outer surface of the fender panels 32 enables the vehicle to slide easily along the fender panels 32 following impact. The amount of penetration of the vehicle into the side of the impact attenuation device 10 is small, and, since the frictional force developed between the vehicle and the fender panels 32 is relatively small, the vehicle is redirected and does not "pocket" and spin out. The pullout cables 66 prevent movement of the diaphragm members 24 away from each other and thereby maintain pressure on the buffer elements 14 during a side angle impact.

From the foregoing, it should be apparent that an improved anchoring system for a reusable impact attenuation device has been disclosed. The particular anchor assemblies of the present invention can be used with any size of impact attenuation device by simply altering the lateral spacing between the anchor assemblies. The anchor assemblies can be used with impact attenuation devices having either liquid buffer elements or dry buffer elements by selectively utilizing a number of the secondary mounting brackets provided. The anchor assemblies are economical to manufacture, convenient to install, and efficient to stock. Because only one universal size and configuration of anchor assembly is required regardless of the type and size of the impact attenuation device, the expenses of inventory and installation are significantly reduced.

Of course, it should be understood that various changes and modifications to the preferred embodiment described will be apparent to those skilled in the art. For example, the dimensions and shapes of the anchor plate, the central mounting bracket, and the secondary mounting brackets could be altered without affecting the operation of the anchor assemblies. Similarly, other mounting means could be employed in place of the various mounting holes while achieving the advantages of the present invention. Further, the anchor assemblies may be formed as a single piece or may be joined by screws, swaging, staking or brazing instead of welding. It is therefore intended that the foregoing detailed description be regarded as illustrative rather than limiting and that it be understood that it is the following claims, including all equivalents, that are intended to define the scope of this invention.

We claim:

1. In a reusable impact attenuation device of the type which includes a rigid backing member adapted to be positioned adjacent a fixed structure, a plurality of buffer elements positioned in an ordered array extending forwardly of the backing member for absorbing and dissipating energy, a plurality of diaphragm members interposed in the array and extending laterally outward of the array at spaced intervals, a plurality of fender panels pivotally coupled to the laterally extending ends of the diaphragm members and partially overlapping the fender panels coupled to the succeeding diaphragm members, and means for collapsibly interconnecting the backing member and the diaphragm members, the improvement comprising:

a pair of laterally spaced anchor assemblies connected to the interconnecting means at the forward end of the impact attenuation device, the anchor assemblies being adapted for fixing to the ground and being symmetrical, identical, and interchangeable with each other.

2. The improvement in a reusable impact attenuation device as recited in claim 1 further comprising central mounting means and secondary mounting means upon each of the anchor assemblies, the secondary mounting means being provided at two mounting locations equally spaced laterally on opposite sides of the central mounting means, the two mounting locations being symmetrical with respect to the central mounting means.

3. The improvement in a reusable impact attenuation device as recited in claim 2 wherein the central mounting means is larger and stronger than the secondary mounting means and wherein one of the two mounting locations of the secondary mounting means of each anchor assembly remains unused, the unused mounting location of the secondary mounting means being provided for universality of the anchor assemblies.

4. The improvement in a reusable impact attenuation device as recited in claim 2 wherein the central mounting means comprises a bar adapted to receive a shackle and wherein each of the secondary mounting means comprises a smaller bar adapted to receive a shear pin so as to permit the secondary mounting means to be releasable from the nonrigid means upon an impact by shearing of the shear pin.

5. In a reusable impact attenuation device of the type which includes a rigid backing member adapted to be positioned adjacent a fixed structure, a plurality of buffer elements positioned in an ordered array extending forwardly of the backing member for absorbing and dissipating energy, a plurality of diaphragm members interposed in the array and extending laterally outward of the array at spaced intervals, a plurality of fender panels pivotally coupled to the laterally extending ends of the diaphragm members and partially overlapping the fender panels coupled to the succeeding diaphragm members, and a pair of restraining cables interconnecting the backing member and the diaphragm members, the improvement comprising:

a pair of identical laterally spaced anchor assemblies adapted for fixing to the ground at the forward end of the impact attenuation device;

a central mounting member on each of the anchor assemblies connected to the forward end of one of the restraining cables for securing the restraining cables;

two secondary mounting members on each of the anchor assemblies such that the secondary mounting members are symmetrical with respect to the central mounting member; and a pair of secondary cables releasably connecting one of the diaphragm members to a selected one of the secondary mounting members of each of the anchor assemblies for maintaining the impact attenuation device in position before an impact.

6. The improvement in a reusable impact attenuation device as recited in claim 5 wherein the connection between each of the central mounting members and the respective restraining cable is adjacent the rearward edge of the respective anchor assembly and wherein the secondary mounting members are adjacent the forward edge of the respective anchor assembly.

7. The improvement in a reusable impact attenuation device as recited in claim 5 wherein the central mounting member and the two secondary mounting members are parallel bars fixed to the anchor assemblies and provided with mounting holes for the respective cables.

* * * * *